US009877565B2

(12) United States Patent
Sasaki

(10) Patent No.: US 9,877,565 B2
(45) Date of Patent: Jan. 30, 2018

(54) LIQUID COSMETIC MATERIAL CONTAINER

(71) Applicant: TOKIWA CORPORATION, Nakatsugawa-shi, Gifu (JP)

(72) Inventor: Arata Sasaki, Kawaguchi (JP)

(73) Assignee: TOKIWA CORPORATION, Nakatsugawa-Shi, Gifu (JP)

( * ) Notice: Subject to any disclaimer, the term of this patent is extended or adjusted under 35 U.S.C. 154(b) by 0 days.

(21) Appl. No.: 15/336,842

(22) Filed: Oct. 28, 2016

(65) Prior Publication Data

US 2017/0127796 A1 May 11, 2017

(30) Foreign Application Priority Data

Nov. 6, 2015 (JP) ..... 2015-218508

(51) Int. Cl.
*A45D 34/04* (2006.01)

(52) U.S. Cl.
CPC .... *A45D 34/042* (2013.01); *A45D 2200/1072* (2013.01)

(58) Field of Classification Search
CPC .... A45D 34/04; A45D 34/042; A45D 34/043; A45D 34/045
See application file for complete search history.

(56) References Cited

U.S. PATENT DOCUMENTS 6,634,821 B2 * 10/2003 Gueret ..... A45D 34/045 401/126
9,149,107 B2 * 10/2015 Chan ..... A45D 34/042
2008/0056807 A1 * 3/2008 Vintimiglia ..... A45D 34/042 401/277
2008/0193193 A1 * 8/2008 Pechko ..... A45D 34/04 401/31
2009/0010702 A1 * 1/2009 Nehashi ..... A45D 34/042 401/24
2012/0141187 A1 * 6/2012 Chang ..... A45D 34/04 401/143
2015/0296968 A1 * 10/2015 Hwang ..... A45D 34/042 15/106
2017/0245618 A1 * 8/2017 Chen ..... A45D 34/045

FOREIGN PATENT DOCUMENTS

JP H0970314 A 3/1997

* cited by examiner

*Primary Examiner* — Jennifer C Chiang
*Assistant Examiner* — Bradley Oliver
(74) *Attorney, Agent, or Firm* — Bacon & Thomas, PLLC

(57) ABSTRACT

When a lid storing an impregnation body impregnated with a liquid cosmetic material is attached to a container body holding a thick applicator at a front end thereof, a slope of a front end face of the thick applicator is stuck into the impregnation body to thereby easily intrude thereinto. Accordingly, an appropriate amount of the liquid cosmetic material impregnated into the impregnation body can be held and a thick line can be drawn by the thick applicator storing the liquid cosmetic material. In this way, since the liquid cosmetic material is stored in the lid while being impregnated with the impregnation body, the liquid cosmetic material does not leak from the lid even in a posture in which the lid separated from the container body is disposed, for example, laterally or reversely.

8 Claims, 7 Drawing Sheets

LIQUID COSMETIC MATERIAL CONTAINER

TECHNICAL FIELD

The present invention relates to a liquid cosmetic material container that applies a liquid cosmetic material.

BACKGROUND ART

Recently, there is known a liquid cosmetic material container which uses a liquid cosmetic material stored in a lid (a cap) instead of a container (for example, see Patent Document 1). In the liquid cosmetic material container, a front end of a container body is provided with an application tool formed by felt or the like, having a tapered shape like a tip of a ballpoint pen, and having, for example, a liquid cosmetic material such as an eyeliner cosmetic material impregnated and stored therein. Then, a bottomed cylindrical lid is separably attached to the container body to cover the application tool. Here, when an opening end side of the lid is closed by a sealing member, a tank room storing the liquid cosmetic material is formed from the sealing member to a bottomed cylindrical bottom portion side and the tank room stores the liquid cosmetic material. A small hole is opened at a substantially center portion of the sealing member. Thus, in a state where the lid is attached to the container body, a front end of the application tool enters the tank room through the small hole of the sealing member to be immersed into the liquid cosmetic material. In a state where the lid is separated from the container body for the application of the liquid cosmetic material, the liquid cosmetic material can be applied to an application target by the application tool since the liquid cosmetic material is impregnated and stored in the application tool. Then, in a state where the lid is separated from the container body, the small hole of the sealing member is opened. However, since the viscosity of the liquid cosmetic material is relatively high, the liquid cosmetic material of the tank room does not leak through the small hole.

CITATION LIST

Patent Document

Patent Document 1: JP H09-70314 A

SUMMARY OF THE INVENTION

Problem to be Solved by the Invention

Here, there is a need to draw a thick line compared to the related art, for example, when an eye line is drawn by the eyeliner cosmetic material. In order to simply draw such a thick eye line, a thick applicator (having a large diameter) can be used. However, when the thick applicator is used in the liquid cosmetic material container, the small hole through which the applicator passes needs to be increased in size. When the small hole is increased in size in this way, if the lid falls down even when the lid separated from the container body is disposed so that the opening end is directed upward, the liquid cosmetic material of the tank room leaks through the hole. Further, when the lid is disposed, for example, laterally or reversely (so that the opening side is directed downward), the liquid cosmetic material of the tank room leaks through the hole.

Here, an object of the invention is to provide a liquid cosmetic material container capable of drawing a thick line while preventing a liquid cosmetic material from leaking from a lid regardless of a posture of the lid separated from a container body.

Means for Solving the Problem

According to the invention, there is provided a liquid cosmetic material container including: an applicator that is able to store and apply a liquid cosmetic material; a container body that holds the applicator at a front end thereof; an impregnation body that is impregnated with the liquid cosmetic material; and a lid that is formed in a bottomed cylindrical shape, stores the impregnation body, and is separably attached to the container body to cover the applicator, wherein a front end face of the applicator is provided with a slope inclined with respect to a perpendicular plane for an axis of the applicator, and wherein the slope of the applicator is stuck into the impregnation body to intrude thereinto in a state where the lid is attached to the container body.

According to such a liquid cosmetic material container, when the lid storing the impregnation body impregnated with the liquid cosmetic material is attached to the container body holding the thick applicator at the front end thereof, the slope provided in the front end face of the thick applicator is stuck into the impregnation body to thereby easily intrude thereinto and thus an appropriate amount of the liquid cosmetic material impregnated into the impregnation body can be stored. For this reason, a thick line can be drawn by the thick applicator storing the liquid cosmetic material. In this way, since the liquid cosmetic material is stored in the lid while being impregnated into the impregnation body, the liquid cosmetic material does not leak from the lid even in a posture in which the lid separated from the container body is disposed, for example, laterally or reverse.

Here, the applicator may be a first applicator having a cylindrical shape and the liquid cosmetic material container may further include: a second applicator that is accommodated in a cylindrical hole of the first applicator to be movable in an axial direction; a movable body that has a front end provided with the second applicator and is movable in the axial direction; and an operation portion that is operated so that the movable body moves in the axial direction and the second applicator appears and disappears from the slope of the front end of the first applicator. With such a configuration, a thick line can be drawn by the first applicator in such a manner that the movable body is moved backward by the operation of the operation portion and the second applicator is immersed from the slope of the front end of the first applicator. Further, a thin line can be drawn by the second applicator in such a manner that the movable body is moved forward by the operation of the operation portion and the second applicator appears from the slope of the front end of the first applicator. In this way, a thick line and a thin line can be drawn by one container.

Here, when the first applicator is formed as, for example, a fiber bundle or a porous material such as urethane sponge in order to store the cosmetic material, a technique of opening the cylindrical hole while preventing a misalignment of the cylindrical hole from the center is very difficult.

Here, since the first applicator is formed by an elastic body or resin, the cylindrical hole can be easily opened to the center with high accuracy. Although the elastic body or the resin does not have a water absorbing property, the flocked portion is formed in the outer peripheral face. For this reason, the liquid cosmetic material can be easily stored (the liquid cosmetic material can be easily contained) and can be used for the application.

When the second applicator is formed by fiber, the liquid cosmetic material can be easily stored (absorbed), the application feeling is satisfactory, and a thin line can be easily drawn.

The liquid cosmetic material container may further include: an inner tray that stores the impregnation body and is accommodated in the lid to be movable in the axial direction; an urging member that is provided in the lid and urges the inner tray toward an opening end side of the lid; and an attachment portion that is provided in an inner peripheral face at the opening end side of the lid and is used to separably attach the lid to the container body, wherein in a state where the lid is attached to the container body, the inner tray may be located at the bottomed cylindrical bottom portion side of the lid, and wherein in a state where the lid is separated from the container body, the inner tray may be urged by the urging member so that the inner tray moves toward the opening end side and covers and hides the attachment portion from the inside. In this way, in a state where the lid is separated from the container body, the inner tray moves to cover and hide the attachment portion from the inside. For this reason, when the extra liquid cosmetic material adhering to the applicator is stripped toward the opening end side of the lid, the extra liquid cosmetic material is stripped by the inner tray. Accordingly, it is possible to prevent the liquid cosmetic material from adhering to the attachment portion and to prevent a problem in which the liquid cosmetic material adhering to the attachment portion is solidified and the lid cannot be attached to the container body.

Effect of the Invention

In this way, according to the invention, it is possible to draw a thick line while preventing a liquid cosmetic material from leaking from a lid regardless of a posture of the lid separated from a container body.

MODE(S) FOR CARRYING OUT THE INVENTION

Figure 1:
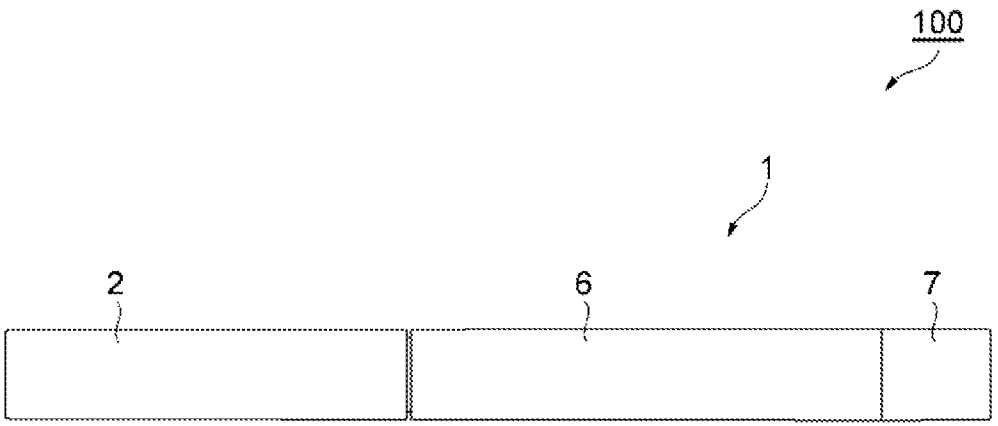
FIG. 1 is an external view showing a liquid cosmetic material container according to an embodiment of the invention.
Figure 5:
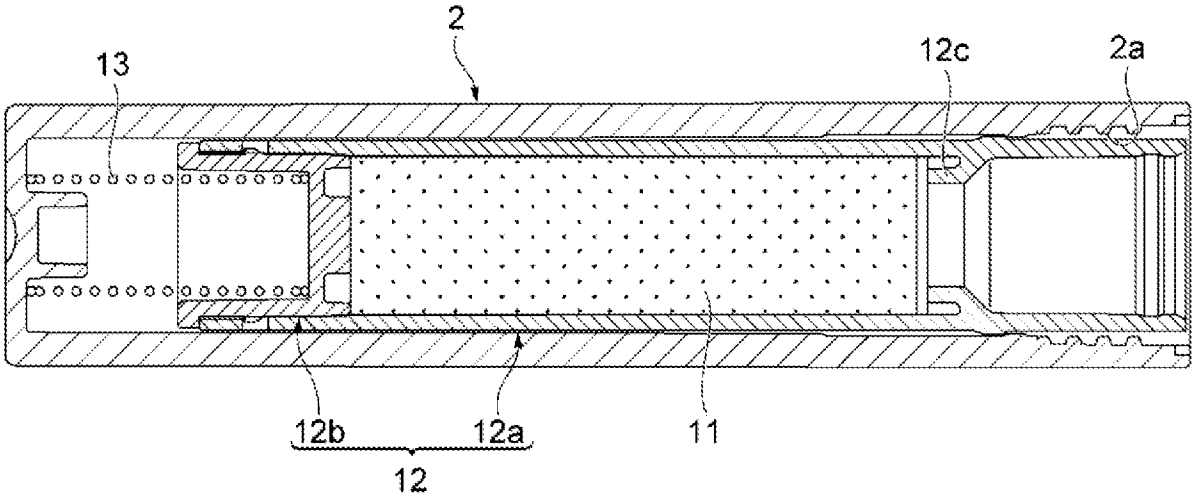
FIG. 5 is a longitudinal sectional view showing the lid separated from the liquid cosmetic material container shown in FIG. 2.
Figure 6:
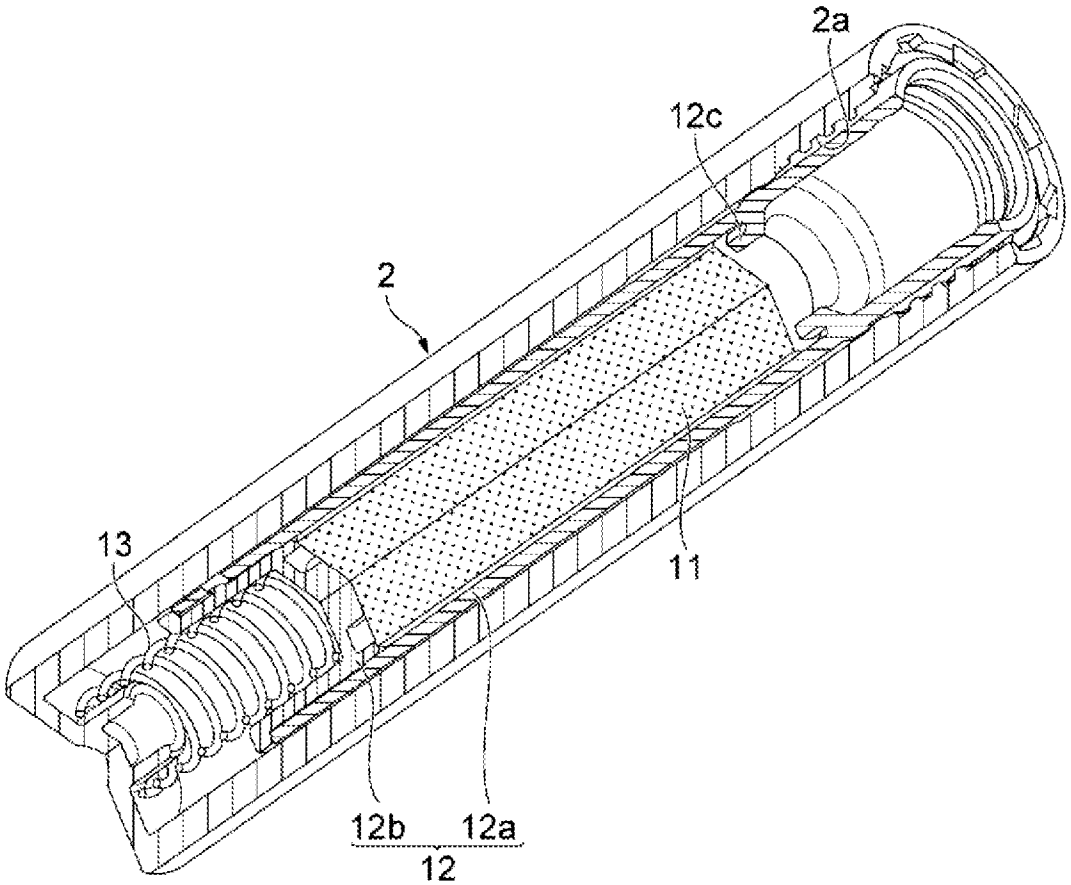
FIG. 6 is a cutaway perspective view of the lid shown in FIG. 5.
Figure 7:
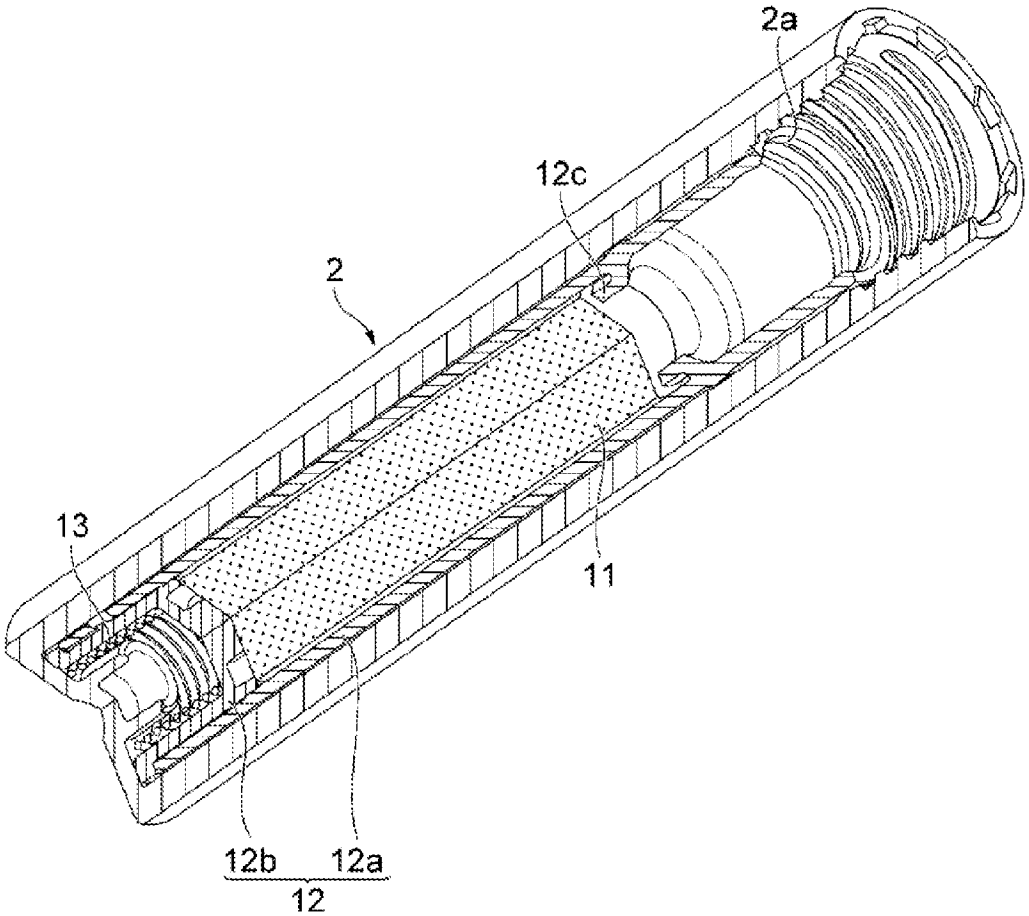
FIG. 7 is a cutaway perspective view showing a lid state where the lid shown in FIG. 6 is attached to a container body.

Hereinafter, a preferred embodiment of a liquid cosmetic material container of the invention will be described with reference to FIGS. 1 to 7. FIG. 1 is an external view showing a liquid cosmetic material container according to an embodiment of the invention, FIG. 2 is a longitudinal sectional view of FIG. 1, FIG. 3 is a longitudinal sectional view showing a state where a lid is separated from the state of FIG. 2 and a second applicator is delivered, FIG. 4 is a perspective view at a front end side of FIG. 3, FIG. 5 is a longitudinal sectional view showing a lid separated from a container body, FIG. 6 is a cutaway perspective view of the lid shown in FIG. 5, and FIG. 7 is a cutaway perspective view showing a lid state where the lid shown in FIG. 6 is attached to the container body.

The liquid cosmetic material container of the embodiment contains a liquid cosmetic material inside the lid (cap). Then, a line can be immediately drawn by an applicator of a front end of the container in a state where the lid is separated from the container. Here, the liquid cosmetic material is desirably an eyeliner cosmetic material and the liquid cosmetic material container is configured as an eyeliner cosmetic material container.

Figure 2:
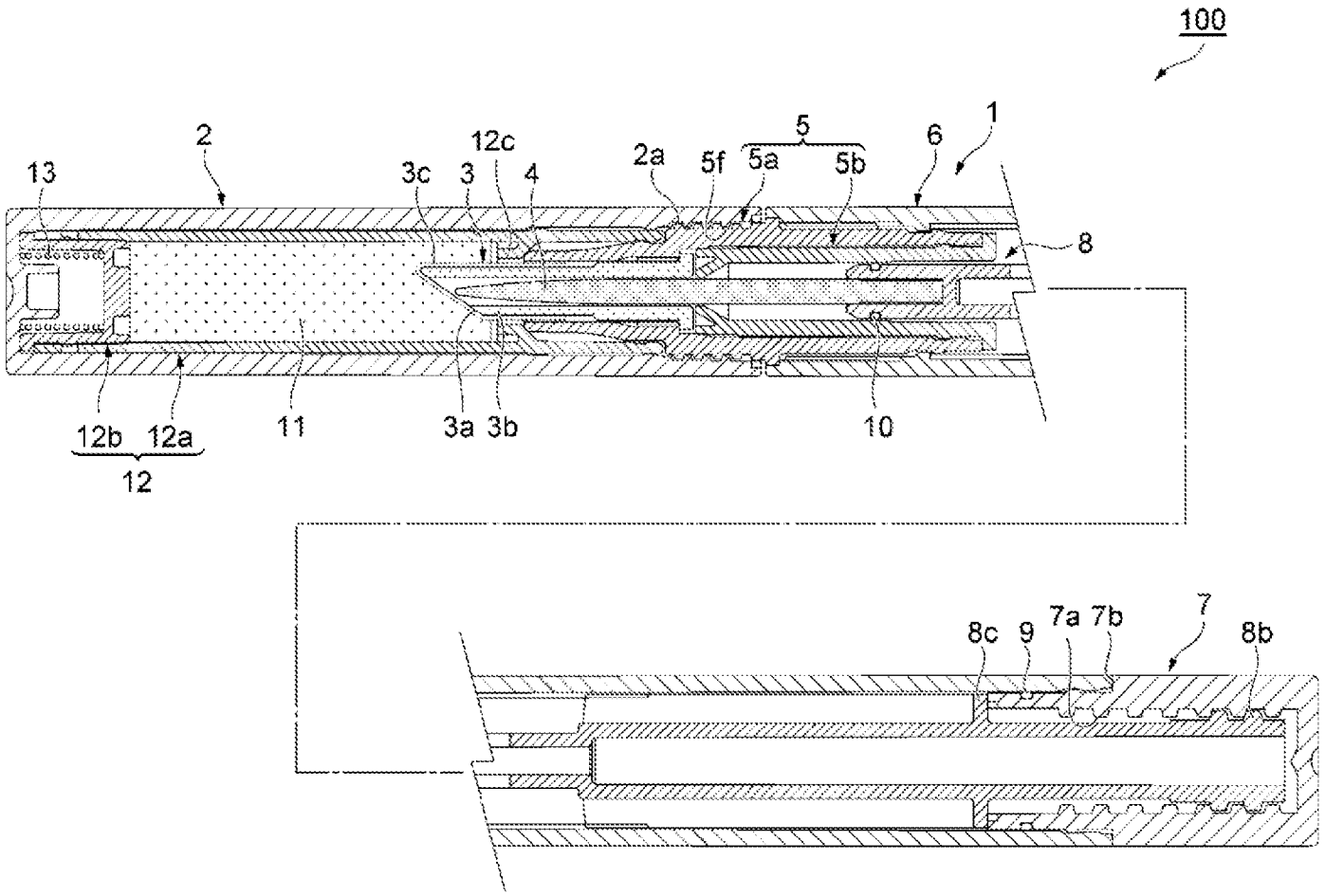
FIG. 2 is a longitudinal sectional view showing the liquid cosmetic material container shown in FIG. 1.

As shown in FIGS. 1 and 2, an eyeliner cosmetic material container 100 has an appearance including a container body 1 and a lid 2 separably attached to the container body 1. Here, a front end of the container body 1 is provided with an applicator for applying an eyeliner cosmetic material. As the applicator, provided are two kinds of applicators, that is, a first applicator 3 having a thick diameter and a second applicator 4 having a thin diameter and disposed within the first applicator 3.

Figure 3:
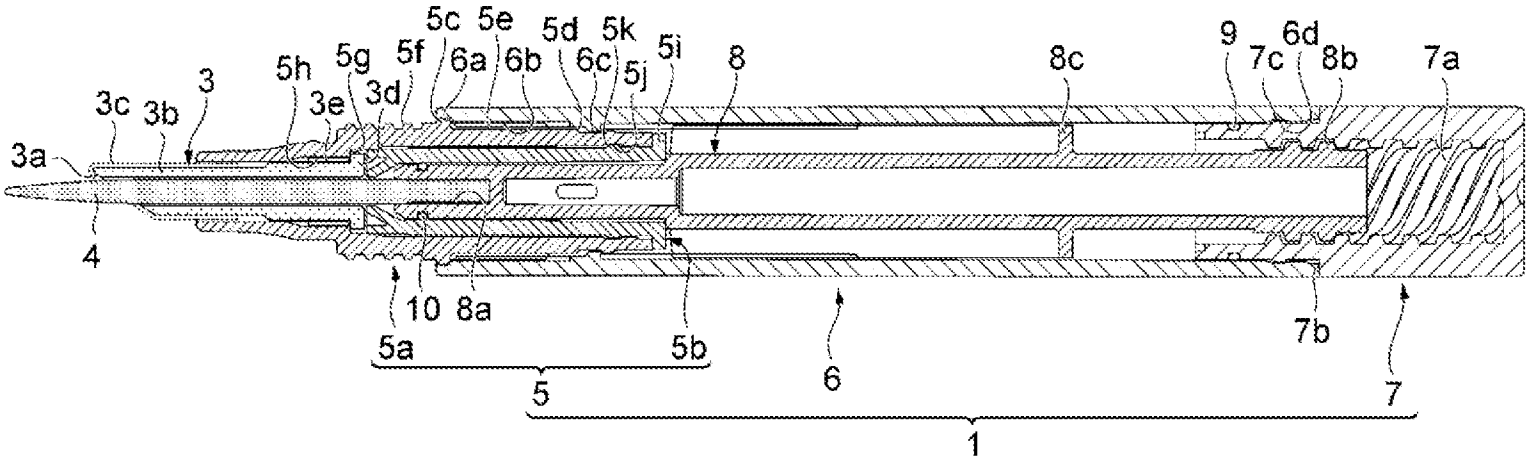
FIG. 3 is a longitudinal sectional view showing a state where a lid is separated from the liquid cosmetic material container shown in FIG. 2 and a second applicator is delivered.
Figure 4:
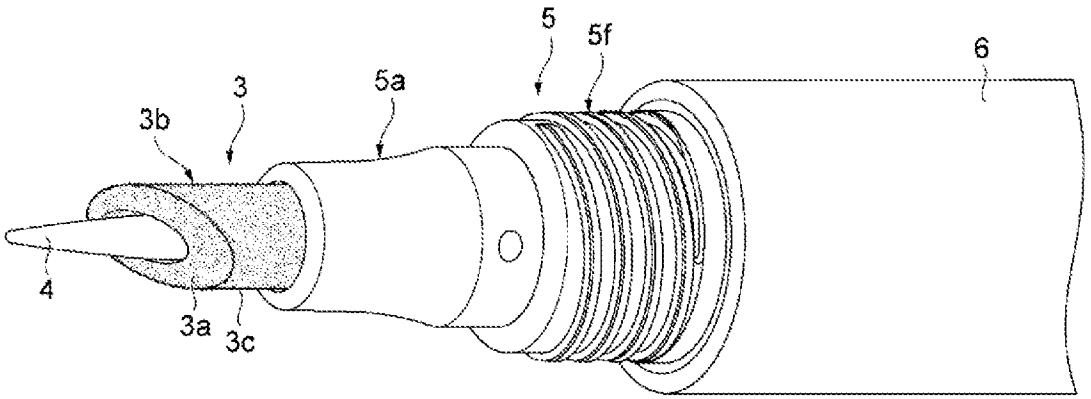
FIG. 4 is a perspective view showing a front end side of FIG. 3.

The first applicator 3 is formed in a cylindrical shape as shown in FIGS. 3 and 4. Here, a front end face of the first applicator is provided with a slope 3*a* which is inclined with respect to a perpendicular plane for an axis and the outer peripheral face of the cylindrical portion 3*b* is provided with a flocked portion 3*c*. Since the slope 3*a* is formed by obliquely cutting a cylinder, an oval cylindrical face is formed to be wider than a cylindrical face. Here, the flocked portion 3*c* is formed one face at a front end side of the cylindrical portion 3*b* including the slope 3*a*. A flange portion 3*d* is provided at a rear end of the first applicator 3 and a knurl 3*e* is provided in the circumferential direction to be located at the outer peripheral face at the front end side in relation to the flange portion 3*d*.

The cylindrical portion 3*b* of the first applicator 3 is formed by an elastic body or resin. The elastic body can be desirably used due to a good feeling for an application and rubber or elastomer is desirable. In the case of the resin, PP (polypropylene) is desirable. Here, the flocked portion 3*c* is desirably formed by polyester fibers.

The second applicator 4 is disposed inside a cylindrical hole of the first applicator 3 to be movable in the axial direction. Here, the second applicator 4 is formed by polishing a fiber bundle having thin fibers formed of nylon and fixed thereto by an adhesive and is a so-called tip having an acute front end and having the same appearance as a brush.

The container body 1 includes, as shown in FIG. 3, a holding cylinder 5 which holds the first applicator 3, a main body cylinder 6 which is connected to a rear end side of the holding cylinder 5 and is elongated in the axial direction, and an operation cylinder 7 which serves as an operation portion connected to a rear end side of the main body cylinder 6 and is operated by a user. The container body 1 stores a movable body 8 which is moved in the axial direction by the operation of the operation cylinder 7.

The holding cylinder 5 includes a first holding cylinder 5*a* and a second holding cylinder 5*b*.

The first holding cylinder 5*a* is attached to the main body cylinder 6 and is used to suppress a forward movement of the first applicator 3 in the axial direction. Here, the first holding cylinder is formed in a cylindrical shape of which a front end is tapered. An annular flange portion 5*c* which abuts against the main body cylinder 6 is provided at the outer peripheral face located at an intermediate position of the first holding cylinder 5*a* in the axial direction and an annular concave portion 5*d* which engages with the main body cylinder 6 in the axial direction so that the first holding cylinder 5*a* does not move toward the front end side is provided at the outer peripheral face located at the rear end side in relation to the flange portion 5*c*. A knurl 5*e* which engages with the main body cylinder 6 in the circumferential direction is provided between the concave portion 5*d* and the flange portion 5*c* of the outer peripheral face of the first holding cylinder 5*a*.

A male screw 5*f* which serves as an attachment portion for separably attaching the lid 2 is provided at the outer peripheral face at the front end side in relation to the flange portion 5*c* of the first holding cylinder 5*a*. The front end side of the inner peripheral face of the first holding cylinder 5*a* is formed in a small diameter so that a step 5*g* is formed at an intermediate position in the axial direction. The step 5*g* is formed as a face against which the flange portion 3*d* of the first applicator 3 abuts in the axial direction. The inner peripheral face of the first holding cylinder 5*a* at the front side of the step 5*g* is provided with a knurl 5*h* which engages with the knurl 3*e* of the first applicator 3 in the circumferential direction. The inner peripheral face at the rear end side of the first holding cylinder 5*a* is provided with a concave portion 5*j* which is formed in an annular shape to attach the second holding cylinder 5*b* in the axial direction.

The second holding cylinder 5*b* is formed in a substantially cylindrical shape to be inserted into the first holding cylinder 5*a* and a rear end thereof is provided with a flange portion 5*i* which abuts against a rear end face of the first holding cylinder 5*a*. The outer peripheral face of the second holding cylinder 5*b* at the front end side in relation to the flange portion 5*i* is provided with a convex portion 5*k* which is formed in an annular shape to engage with the concave portion 5*j* of the first holding cylinder 5*a* in the axial direction.

Then, the first applicator 3 is inserted into a cylindrical hole of the rear end of the first holding cylinder 5*a* from a front end side of the first applicator, the flange portion 3*d* abuts against the step 5*g* of the first holding cylinder 5*a* to suppress a forward movement in the axial direction, and the knurl 3*e* engages with the knurl 5*h* of the first holding cylinder 5*a* in the circumferential direction. Accordingly, the first applicator is attached to the first holding cylinder 5*a* so as not to be rotatable. Then, the second holding cylinder 5*b* is inserted into the cylindrical hole of the rear end of the first holding cylinder 5*a* from a front end side of the second holding cylinder, the flange portion 5*i* abuts against the rear end face of the first holding cylinder 5*a*, and the convex portion 5*k* engages with the concave portion 5*j* of the first holding cylinder 5*a* in the axial direction. Accordingly, the second holding cylinder is attached to the first holding cylinder 5*a* so as not to be movable in the axial direction. In this state, a front end face of the second holding cylinder 5*b* comes into contact with a rear end face of the first applicator 3 and the flange portion 3*d* of the first applicator 3 is nipped between the step 5*g* of the first holding cylinder 5*a* and the front end face of the second holding cylinder 5*b*. Accordingly, the first applicator 3 is attached to the holding cylinder 5 so as not to be movable in the axial direction. In this state, the front end of the first applicator 3 protrudes by a predetermined amount from the front end of the first holding cylinder 5*a*. Further, in this state, the first holding cylinder 5*a* and the second holding cylinder 5*b* are air-tightly fitted to each other in order to prevent the diffusion of the eyeliner cosmetic material.

The main body cylinder 6 is formed in a cylindrical shape and a front end face thereof is provided with a concave portion 6*a* against which the flange portion 5*c* of the first holding cylinder 5*a* advancing in the axial direction abuts. The inner peripheral face at the rear side of the concave portion 6*a* in the main body cylinder 6 is provided with a knurl 6*b* which engages with the knurl 5*e* of the first holding cylinder 5*a* in the circumferential direction and the inner peripheral face at the rear side of the knurl 6*b* is provided with a convex portion 6*c* which is formed in an annular shape to engage with the concave portion 5*d* of the first holding cylinder 5*a* in the axial direction. The inner peripheral face at the rear end side of the main body cylinder 6 is provided with a concave portion 6*d* which is formed in an annular shape to attach the operation cylinder 7 thereto.

Then, the first holding cylinder 5*a* is inserted into a cylindrical hole of a front end of the main body cylinder 6 from a rear end side of the first holding cylinder, the flange portion 5*c* abuts against the concave portion 6*a* of the main body cylinder 6, and the concave portion 5*d* engages with the convex portion 6*c* of the main body cylinder 6 in the axial direction so that the first holding cylinder is attached to the main body cylinder 6 so as not to be movable in the axial direction. Further, the knurl 5*e* engages with the knurl 6*b* of the main body cylinder 6 in the circumferential direction so that the first holding cylinder is attached to the main body cylinder 6 so as not to be rotatable.

The operation cylinder 7 is formed in a bottomed cylindrical shape so that a female screw 7*a* is provided in an inner peripheral face thereof. The front end side of the operation cylinder 7 is formed so that an outer peripheral face becomes smaller than a bottom portion from the step 7*b* and the outer peripheral face having a small diameter is provided with an annular convex portion 7*c* which engages with the concave portion 6*d* of the main body cylinder 6 in the axial direction.

Then, the operation cylinder 7 is inserted into a cylindrical hole of a rear end of the main body cylinder 6 from the front end side of the operation cylinder, the step 7*b* abuts against a rear end face of the main body cylinder 6, and the convex portion 7*c* engages with the concave portion 6*d* of the main body cylinder 6 in the axial direction. Accordingly, the operation cylinder is attached to the main body cylinder 6 so as to be rotatable and not to be movable in the axial direction.

The movable body 8 is an axial body which is elongated in the axial direction, a front end thereof is provided with a concave portion 8*a* which is recessed in the axial direction, and a rear end of the second applicator 4 is fitted and fixed into the concave portion 8*a*. The rear side of the concave portion 8*a* of the movable body 8 is formed in a cylindrical shape and an outer peripheral face of the rear end thereof is provided with a male screw 8*b* which is threaded into a female screw 7*a* of the operation cylinder 7. Further, a flange portion 8*c* which serves as a retreat limit of the movable body 8 while coming into contact with a front end face of the operation cylinder 7 is provided at the outer peripheral face of the movable body 8 located at an intermediate position in the axial direction.

Then, the male screw 8*b* of the movable body 8 is threaded into the female screw 7*a* of the operation cylinder 7 inward in a state where the holding cylinder 5 including the first applicator 3 is not attached to the main body cylinder 6 as shown in FIG. 2. Accordingly, the flange portion 8*c* comes into contact with the front end face of the operation cylinder 7 so that the movable body 8 reaches a retreat limit. Further, an O-ring 9 which smoothly rotates the operation cylinder 7 while applying an appropriate resistance thereto is disposed between the inner peripheral face of the rear end of the main body cylinder 6 and the outer peripheral face of the front end of the operation cylinder 7.

In this state, as described above, the holding cylinder 5 including the first applicator 3 is attached to the main body cylinder 6 and thus the second applicator 4 advances from the rear side of the cylindrical hole of the first applicator 3. In this state, that is, a state where the movable body 8 is located at a retreat limit, a front end of the second applicator 4 is immersed from the slope 3*a* of the front end of the first applicator 3. This state will be referred to as an initial state. Further, an O-ring 10 is air-tightly disposed between the outer peripheral face of the front end of the movable body 8 and the inner peripheral face of the second holding cylinder 5*b* in order to prevent the diffusion of the eyeliner cosmetic material. The O-ring 10 also serves as a rotation stop member of the movable body 8.

The lid 2 is formed in, as shown in FIGS. 5 and 6, a bottomed cylindrical shape and stores an impregnation body 11 impregnated with an eyeliner cosmetic material. The impregnation body 11 is desirably formed of a porous material. Here, a urethane sponge is particularly desirable.

The impregnation body 11 is stored inside the lid 2 while being stored in the inner tray 12. The inner tray 12 includes a storage portion 12*a* which is formed in a substantially cylindrical shape and a lid portion 12*b* which is formed in a bottomed cylindrical shape and blocks an opening end at the inside (the left side in the drawing) of the storage portion 12*a*. Then, the impregnation body 11 impregnated with the eyeliner cosmetic material is stored in an inner area defined by the storage portion 12*a* and the lid portion 12*b*. The inner peripheral face at the opening end side of the storage portion 12*a* is provided with a stopper 12*c* which is directed toward the impregnation body 11 to suppress the movement of the impregnation body 11 toward the opening end. Such an inner tray 12 is accommodated inside the lid 2 to be movable in the axial direction.

A coil spring 13 which serves as an urging member is interposed between the bottomed cylindrical bottom portion side of the lid 2 and the lid portion 12*b* of the inner tray 12 and the inner tray 12 is urged toward the opening end side of the lid 2 by the coil spring 13. The inner peripheral face at the opening end side of the lid 2 is provided with a female screw 2*a* which serves as an attachment portion threaded into the male screw 5*f* of the first holding cylinder 5*a*.

Then, as shown in FIG. 2, in the initial state where the front end of the second applicator 4 is immersed from the slope 3*a* of the front end of the first applicator 3, the female screw 2*a* of the lid 2 is threaded into the male screw 5*f* of the container body 1. Then, in a state where the lid 2 is attached to the container body 1, the front end of the first holding cylinder 5*a* comes into contact with the stopper 12*c* of the inner tray 12 of the lid 2 and the stopper 12*c* is pressed against the urging force of the coil spring 13. Accordingly, as shown in FIGS. 2 and 7, the inner tray 12 is located at the bottomed cylindrical bottom portion side of the lid 2. As shown in FIG. 2, in the lid attachment state, the front end side of the cylindrical portion 3*b* including the slope 3*a* of the first applicator 3 is stuck (inserted; pierced) into the impregnation body 11 to intrude thereinto.

Here, since the cylindrical portion 3*b* of the first applicator 3 is formed by an elastic body or resin and does not have a water absorbing property, the eyeliner cosmetic material cannot be stored, but an appropriate amount of the eyeliner cosmetic material impregnated into the impregnation body 11 can be stored by the flocked portion 3*c*.

Since the second applicator 4 accommodated into the cylindrical hole of the first applicator 3 is a fiber bundle obtained by fixing thin fibers formed of nylon through an adhesive, an appropriate amount of the eyeliner cosmetic material can be stored in the front end thereof.

Next, when the lid 2 is separated from the container body 1 for the application of the eyeliner cosmetic material, a pressing force of the container body 1 for the stopper 12*c* of the inner tray 12 disappears. For this reason, as shown in FIGS. 5 and 6, the inner tray 12 moves toward the opening end side of the lid 2 by the urging force of the coil spring 13 and the opening end of the inner tray 12 moves to be located on the same plane as the opening end of the lid 2. That is, the female screw 2*a* of the lid 2 in relation to the opening end side of the inner tray 12 is covered and hidden from the inside.

Here, when a thick eye line needs to be drawn, the eyeliner cosmetic material may be applied by the first applicator 3 since an appropriate amount of the eyeliner cosmetic material is stored in the first applicator 3 having a thick diameter.

Meanwhile, for example, when a thin eye line for an eye inner corner or an eye tail needs to be drawn, the operation cylinder 7 is rotated to deliver the movable body 8. Thus, as shown in FIGS. 3 and 4, the front end of the second applicator 4 protrudes from the slope 3*a* of the first applicator 3. Since an appropriate amount of the eyeliner cosmetic material is also stored in the front end of the second applicator 4, a thin eye line can be drawn by the second applicator 4.

Here, an extra eyeliner cosmetic material adhering to the first applicator 3 or the second applicator 4 may be stripped by the opening end side of the inner tray 12 covering and hiding the female screw 2*a* from the inside.

Then, when the operation cylinder 7 is rotated in the reverse direction after the application of the second applicator 4 ends, the movable body 8 can be returned. Accordingly, the front end of the second applicator 4 can be returned to the initial state where the front end is immersed from the slope 3*a* of the front end of the first applicator 3. Further, when the lid 2 is attached to the container body 1, the eyeliner cosmetic material container 100 shown in FIG. 1 is obtained.

In this way, according to the embodiment, when the lid 2 storing the impregnation body 11 impregnated with the eyeliner cosmetic material is attached to the container body 1 holding the first applicator 3 serving as the thick applicator at the front end thereof, the slope 3*a* is easily stuck into the impregnation body 11 since the front end face of the first applicator 3 is provided with the slope 3*a* and thus an appropriate amount of the eyeliner cosmetic material impregnated with the impregnation body 11 can be stored. For this reason, a thick line can be drawn by the first applicator 3 which is a thick applicator storing the eyeliner cosmetic material. Further, since the eyeliner cosmetic material is stored in the lid 2 while being impregnated into the impregnation body 11 in this way, the eyeliner cosmetic material does not leak from the lid 2 even in a posture in which the lid 2 separated from the container body 1 is disposed, for example, laterally or reversely.

According to the embodiment, since the movable body 8 is moved backward by the operation of the operation cylinder 7 so that the second applicator 4 is immersed from the slope 3*a* of the front end of the first applicator 3, a thick line can be drawn by the first applicator 3. Meanwhile, since the movable body 8 is moved forward by the operation of the operation cylinder 7 so that the second applicator 4 appears from the slope 3*a* of the front end of the first applicator 3, a thin line can be drawn by the second applicator 4. In this way, a thick line or a thin line can be drawn by one container in such a manner that the second applicator 4 appears and disappears from the slope 3*a*. That is, two kinds of lines, that is, a thick line and a thin line can be selectively drawn.

Since the first applicator 3 is formed by an elastic body or resin, the cylindrical hole can be easily opened to the center with high accuracy. Although the elastic body or the resin does not have a water absorbing property, the flocked portion 3*c* is formed in the outer peripheral face of the cylindrical portion 3*b*. For this reason, the eyeliner cosmetic material can be easily stored and can be used for the application. Further, when the first applicator 3 is formed as, for example, a fiber bundle or a porous material such as urethane or sponge in order to store the eyeliner cosmetic material, a technique of opening the cylindrical hole while preventing a misalignment of the cylindrical hole from the center is very difficult.

Since the second applicator 4 is formed by fiber, the eyeliner cosmetic material can be easily stored, the application feeling is satisfactory, and a line can be easily drawn.

In a state where the lid 2 is attached to the container body 1, the inner tray 12 is located at the bottomed cylindrical bottom portion side of the lid 2. Meanwhile, in a state where the lid 2 is separated from the container body 1, the inner tray is urged by the coil spring 13 to move toward the opening end side of the lid 2 and cover and hind the female screw 2*a* from the inside. For this reason, when the extra eyeliner cosmetic material adhering to the applicators 3 and 4 is stripped by the opening end side of the lid 2, the extra eyeliner cosmetic material is stripped by the inner tray 12. Accordingly, it is possible to prevent the eyeliner cosmetic material from adhering to the female screw 2*a* and thus to prevent a problem in which the eyeliner cosmetic material adhering to the female screw 2*a* is solidified and thus the lid 2 cannot be attached to the container body 1.

In the liquid cosmetic material container of the related art (JP H09-70314 A), there is concern that the liquid cosmetic material in the tank room may leak through the small hole when the liquid cosmetic material has low viscosity. However, according to the embodiment, the viscosity may be high or low.

According to the embodiment, since the applicators 3 and 4 are not directly immersed into the eyeliner cosmetic material, the applicators 3 and 4 can store an appropriate amount of the eyeliner cosmetic material without storing too much eyeliner cosmetic material.

While the embodiment of the invention has been described in detail, the invention is not limited to the above-described embodiment. For example, in the above-described embodiment, a screw is used as the attachment portion for separably attaching the lid 2 to the container body 1. However, an attachment portion such as an engagement portion or a fitting portion separably engaging with the container body 1 in accordance with the movement of the lid 2 in the axial direction may be used.

In the above-described embodiment, the second applicator 4 is moved forward and backward by the rotation of the operation cylinder 7 corresponding to the operation portion rotatably connected to the main body cylinder 6. However, the second applicator 4 may be moved forward and backward in such a manner that the operation portion is connected to the movable body 8 and the operation portion is moved in the axial direction.

In the above-described embodiment, the liquid cosmetic material is particularly desirably set as the eyeliner cosmetic material and the container is set as the eyeliner cosmetic material container 100. However, the liquid cosmetic material may be set as, for example, other liquid cosmetic materials of eyebrow or hair mascaras and the container may be set as other liquid cosmetic material containers.

EXPLANATIONS OF LETTERS OR NUMERALS

1 Container body
2 Lid
2*a* Female screw (attachment portion)
3 First applicator (applicator)
3*a* Slope
3*c* Flocked portion
4 Second applicator
7 Operation cylinder (operation portion)
8 Movable body
11 Impregnation body
12 Inner tray
13 Coil spring (urging member)
100 Eyeliner cosmetic material container (liquid cosmetic material container)

The invention claimed is:

1. A liquid cosmetic material container comprising:
an applicator that is able to store and apply a liquid cosmetic material;
a container body that holds the applicator at a front end thereof;
an impregnation body that is impregnated with the liquid cosmetic material; and
a lid that is formed in a bottomed cylindrical shape, stores the impregnation body, and is separably attached to the container body to cover the applicator,
wherein a front end face of the applicator is provided with a slope inclined with respect to a perpendicular plane for an axis of the applicator, and
wherein the slope of the applicator is stuck into the impregnation body to intrude thereinto in a state where the lid is attached to the container body,
wherein the applicator is a first applicator having a cylindrical shape, and
wherein the liquid cosmetic material container further comprises:
a second applicator that is accommodated in a cylindrical hole of the first applicator to be movable in an axial direction;
a movable body that has a front end provided with the second applicator and is movable in the axial direction; and
an operation portion that is operated so that the movable body moves in the axial direction and the second applicator appears and disappears from the slope of the front end of the first applicator.

2. The liquid cosmetic material container according to claim 1,
wherein the first applicator is formed by an elastic body or resin and a flocked portion is formed on an outer peripheral face of the first applicator.

3. The liquid cosmetic material container according to claim 1, wherein the second applicator is formed by fiber.

4. The liquid cosmetic material container according to claim 2, wherein the second applicator is formed by fiber.

5. The liquid cosmetic material container according to claim 1, further comprising:

an inner tray that stores the impregnation body and is accommodated in the lid to be movable in the axial direction;

an urging member that is provided in the lid and urges the inner tray toward an opening end side of the lid; and an attachment portion that is provided in an inner peripheral face at the opening end side of the lid and is used to separably attach the lid to the container body, wherein in a state where the lid is attached to the container body, the inner tray is located at the bottomed cylindrical bottom portion side of the lid, and wherein in a state where the lid is separated from the container body, the inner tray is urged by the urging member so that the inner tray moves toward the opening end side and covers and hides the attachment portion from the inside.

6. The liquid cosmetic material container according to claim 2, further comprising:

an inner tray that stores the impregnation body and is accommodated in the lid to be movable in the axial direction;

an urging member that is provided in the lid and urges the inner tray toward an opening end side of the lid; and an attachment portion that is provided in an inner peripheral face at the opening end side of the lid and is used to separably attach the lid to the container body, wherein in a state where the lid is attached to the container body, the inner tray is located at the bottomed cylindrical bottom portion side of the lid, and wherein in a state where the lid is separated from the container body, the inner tray is urged by the urging member so that the inner tray moves toward the opening end side and covers and hides the attachment portion from the inside.

7. The liquid cosmetic material container according to claim 3, further comprising:

an inner tray that stores the impregnation body and is accommodated in the lid to be movable in the axial direction;

an urging member that is provided in the lid and urges the inner tray toward an opening end side of the lid; and an attachment portion that is provided in an inner peripheral face at the opening end side of the lid and is used to separably attach the lid to the container body, wherein in a state where the lid is attached to the container body, the inner tray is located at the bottomed cylindrical bottom portion side of the lid, and wherein in a state where the lid is separated from the container body, the inner tray is urged by the urging member so that the inner tray moves toward the opening end side and covers and hides the attachment portion from the inside.

8. The liquid cosmetic material container according to claim 4, further comprising:

an inner tray that stores the impregnation body and is accommodated in the lid to be movable in the axial direction;

an urging member that is provided in the lid and urges the inner tray toward an opening end side of the lid; and an attachment portion that is provided in an inner peripheral face at the opening end side of the lid and is used to separably attach the lid to the container body, wherein in a state where the lid is attached to the container body, the inner tray is located at the bottomed cylindrical bottom portion side of the lid, and wherein in a state where the lid is separated from the container body, the inner tray is urged by the urging member so that the inner tray moves toward the opening end side and covers and hides the attachment portion from the inside.

* * * * *